US006347922B1

(12) United States Patent
Wang

(10) Patent No.: US 6,347,922 B1
(45) Date of Patent: Feb. 19, 2002

(54) PORTABLE COOLING FAN WITH INDENTED BLADES

(76) Inventor: Pierce Wang, No. 46, Alley 26, Lane 667, Chung-Shan Rd., Shen-Kang Hsiang, Taichung Hsien (TW)

( * ) Notice: Subject to any disclaimer, the term of this patent is extended or adjusted under 35 U.S.C. 154(b) by 0 days.

(21) Appl. No.: 09/521,893

(22) Filed: Mar. 9, 2000

(51) Int. Cl.[7] ..... F04D 29/00

(52) U.S. Cl. ..... 416/63; 415/121.2; 416/247 R; 416/235; 416/238

(58) Field of Search ..... 416/63, 246, 247 R, 416/238, 235, 244 R, 236 R; 415/121.2; 417/362, 234

(56) References Cited

U.S. PATENT DOCUMENTS 1,352,848 A * 9/1920 Stanyo ..... 416/238
4,239,459 A * 12/1980 Felter ..... 417/234
5,395,087 A * 3/1995 VanBasten ..... 416/63
5,944,488 A * 8/1999 Matson ..... 416/247 R

* cited by examiner

*Primary Examiner*—Edward K. Look
*Assistant Examiner*—Richard Woo
(74) *Attorney, Agent, or Firm*—Bacon & Thomas, PLLC

(57) ABSTRACT

A portable cooling fan. The fan includes a fixed rack arranged under a frame body, a wheel set disposed laterally on the fixed rack, a support rod located at a position opposite against the wheel set for stabilization, and a handgrip arranged on an upper position of the fan body for carrying the cooling fan easily. In addition, an indented costa is formed on each of the leaf blades by pressing, to enhance intensity of the leaf blades and create turbulence to enlarge the blowing area. The frame body includes a protective mantle, which is supported with a plurality of reinforcement ribs.

4 Claims, 8 Drawing Sheets

PORTABLE COOLING FAN WITH INDENTED BLADES

BACKGROUND OF THE INVENTION

1. Field of the Invention

This invention relates to a cooling fan, particularly to a portable cooling fan that can be moved easily to wherever desired.

2. Description of the Related Art

An air-conditioned space is quite comfortable, however, it consumes more energy than fans, and the users can easily suffer harmful effects, including rheumatism. Therefore, a cooling fan maintains an important role in the age of air conditioners.

An average cooling fan shown in FIG. 1 is usually provided with a heavy base for stabilization purpose that makes it bulky and clumsy.

SUMMARY OF THE INVENTION

The primary object of this invention is to provide a portable cooling fan, wherein a fixed rack equipped with a wheel set is disposed laterally on the fixed rack; a support rod is disposed at a position opposite against the wheel set for stabilization; and, a handgrip is arranged on an upper position of the cooling fan for carrying the cooling fan easily.

Another object of this invention is to provide a portable cooling fan, wherein an indented costa is formed on each of a plurality of leaf blades by pressing for enhancing intensity of the leaf blades and creating turbulence to enlarge blowing area. Also, the leaf blade is made wider in area and smaller in twist angle than conventional fans for intensifying the blown airflow.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention to be made later are described briefly as follows in which.

DETAILED DESCRIPTION OF THE PREFERRED EMBODIMENT

Figure 1:
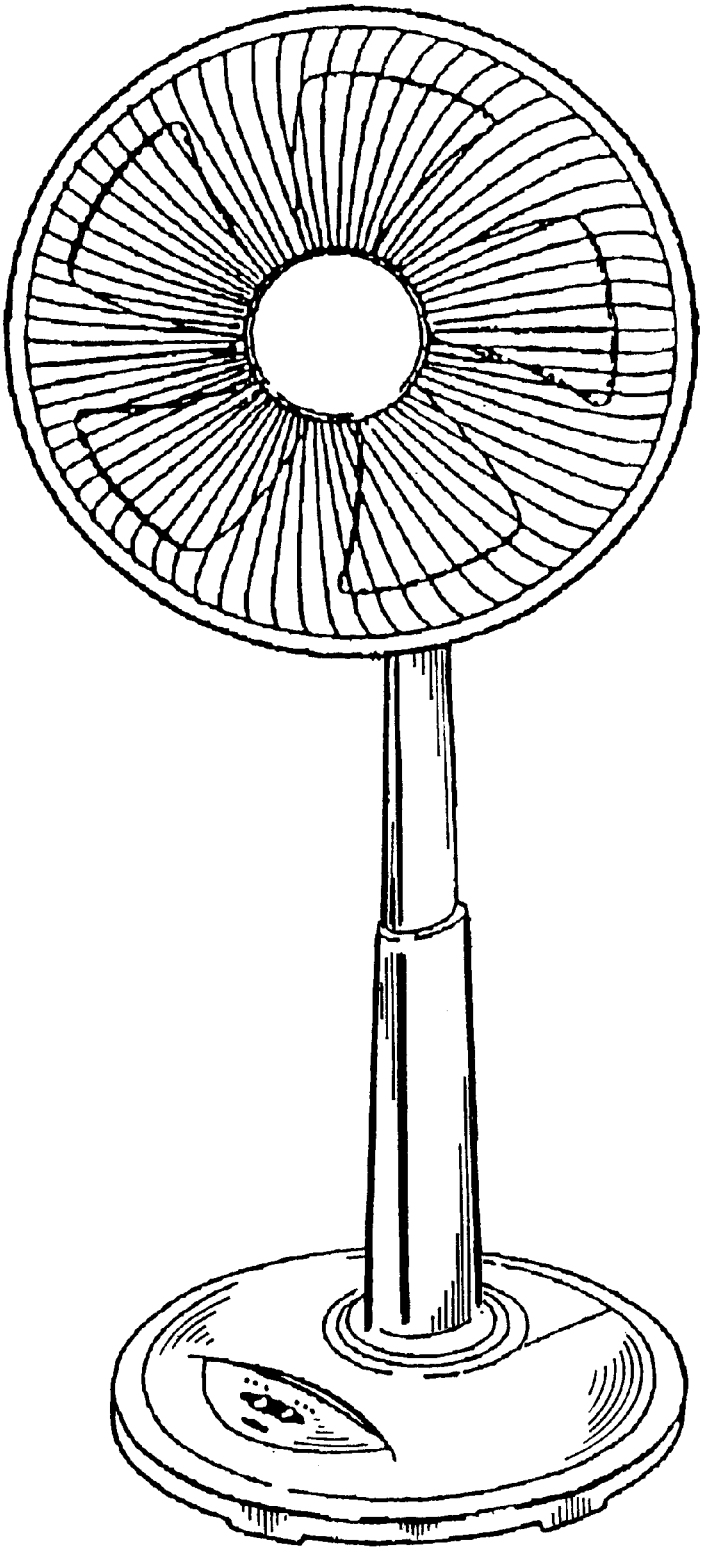
FIG.1 PRIOR ART
FIG. 1 is a front view of a conventional cooling fan.
Figure 2:
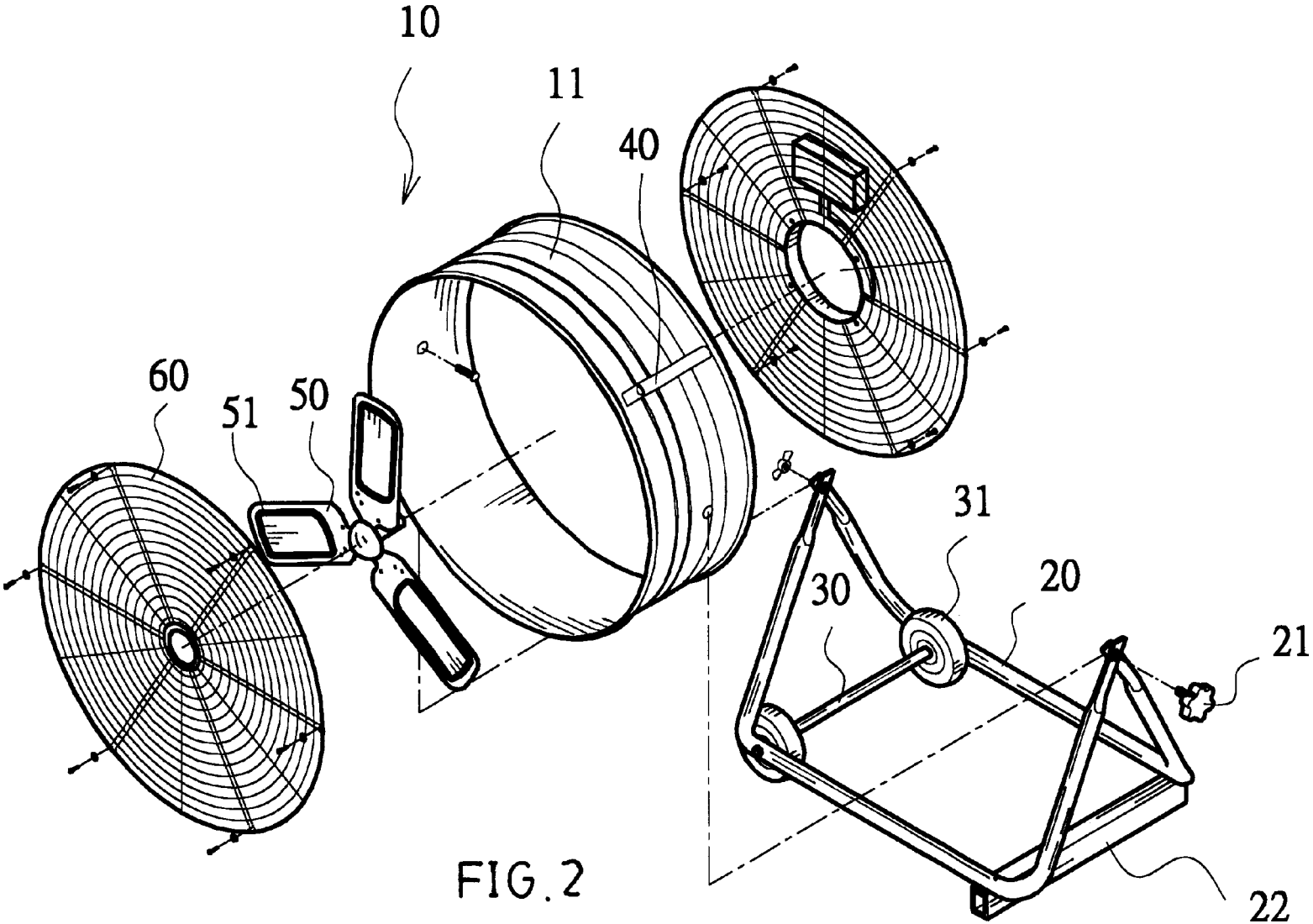
FIG. 2 is a three-dimensional exploded view of this invention.
Figure 3:
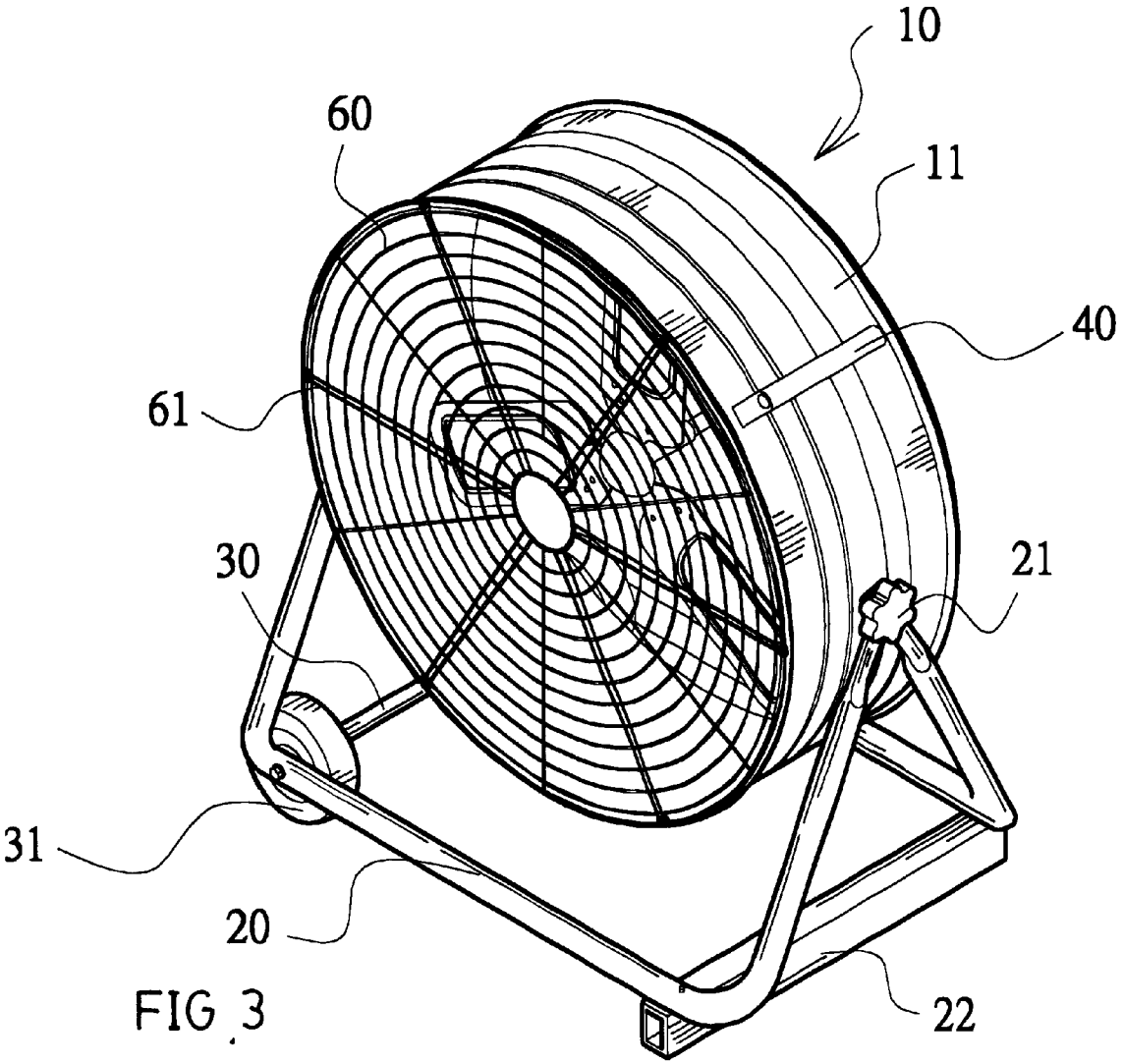
FIG. 3 is a three-dimensional assembled view of this invention.

A portable cooling fan of this invention contains a fan body 10, wherein a fixed rack 20 is disposed at a frame rim of a frame body 11 of the fan body 10. The fixed rack 20 composed of two circular rods bent in U-style is fixed at the frame rim of the frame body 11 laterally with a pair of fixing bolts 21. A horizontally laid support rod 22 and a wheel set 30 with wheels 31 are positioned oppositely under the fixed rack 20, wherein the support rod 22 extends below the fixed rack 20 in order to stabilize the fixed rack 20 on the floor and prevent slippage. A handgrip 40 is provided on the frame body 11 at an upper position so that a user can slightly lift the support rod 22 easily while leaving the wheels 31 in order to roll the cooling fan to desired place.

Figure 4:
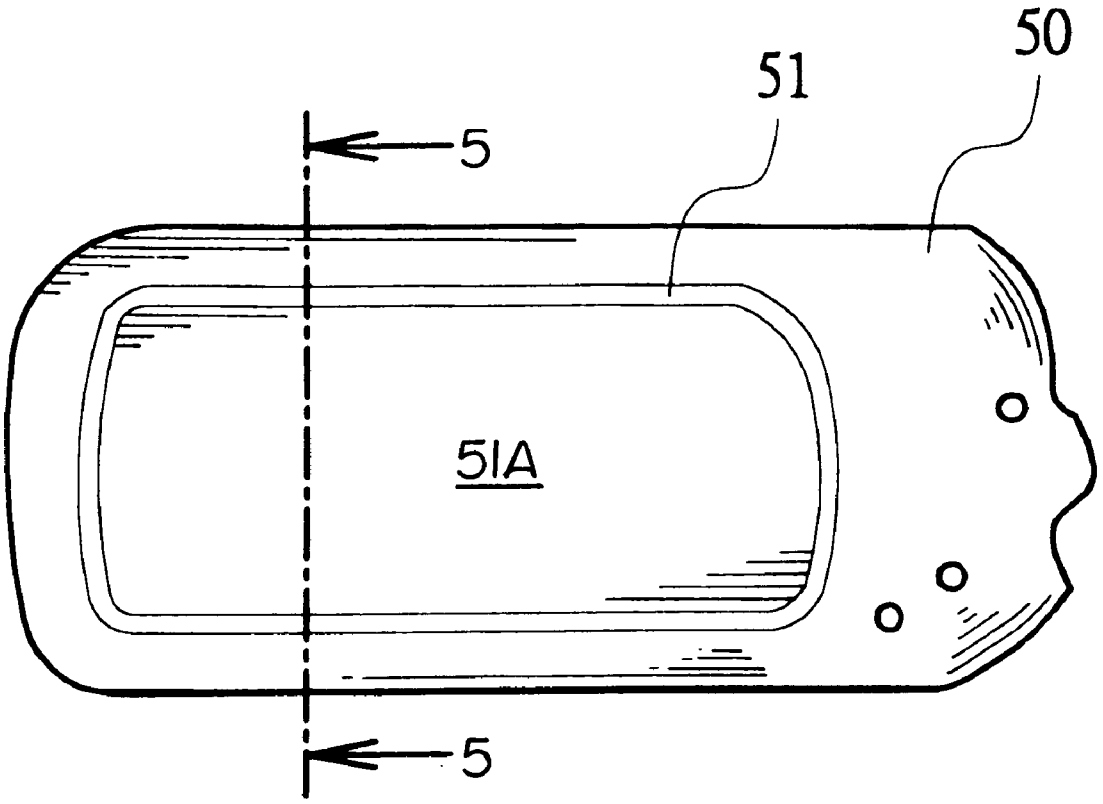
FIG. 4 is a plan view showing a leaf blade of this invention.
Figure 5:
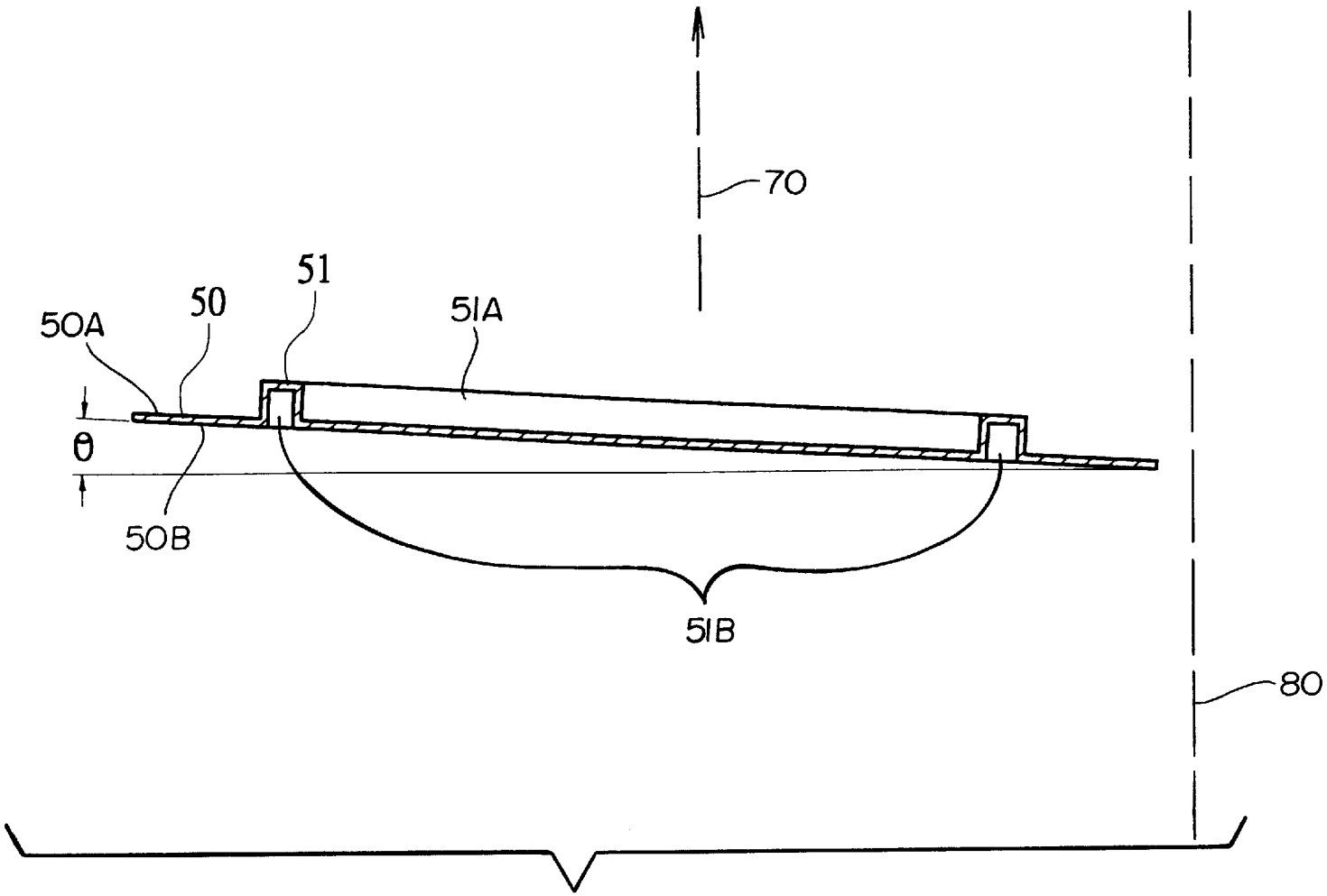
FIG. 5 is a cross-sectional view taken along line 5—5 in FIG. 4.

Moreover, an indented costa 51 is formed on each leaf blade 50 of the fan body 10 by pressing to enhance the intensity of the leaf blades 50 and create added turbulence in order to increase the blown area. The leaf blade 50 is made wider in area and smaller in twist angle θ, as compared with conventional fans for intensifying the blown airflow, as shown in FIGS. 4 and 5. The indented costa 51 is formed substantially along the periphery of each of the leaf blades 50 such that the upper surface 50A of each of the leaf blades 50 includes a protruded hollow portion 51A (as shown in FIG. 5), and the rear surface 50B of each of the leaf blades 50 includes an indented hollow portion, 51B around the periphery of the protruded hollow portion 51A of each of the leaf blades.

Also, as shown in FIG. 5, the leaf blades rotate about a single axis of rotation 80, and the leaf blades 50 are tilted toward the axis of rotation 80 by the twist angle θ, in order to further increase air flow in the direction 70.

Figure 6:
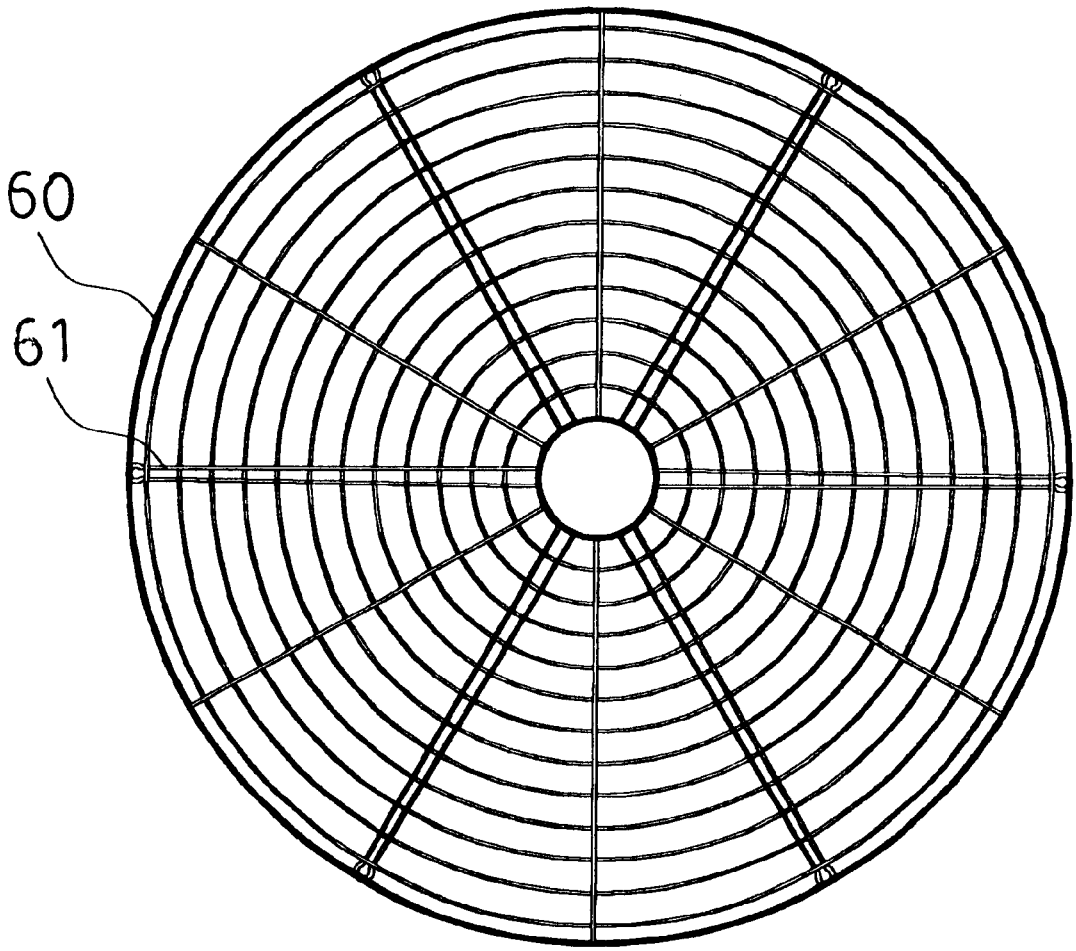
FIG. 6 is a plan view showing a protective mantle of this invention.
Figure 7:
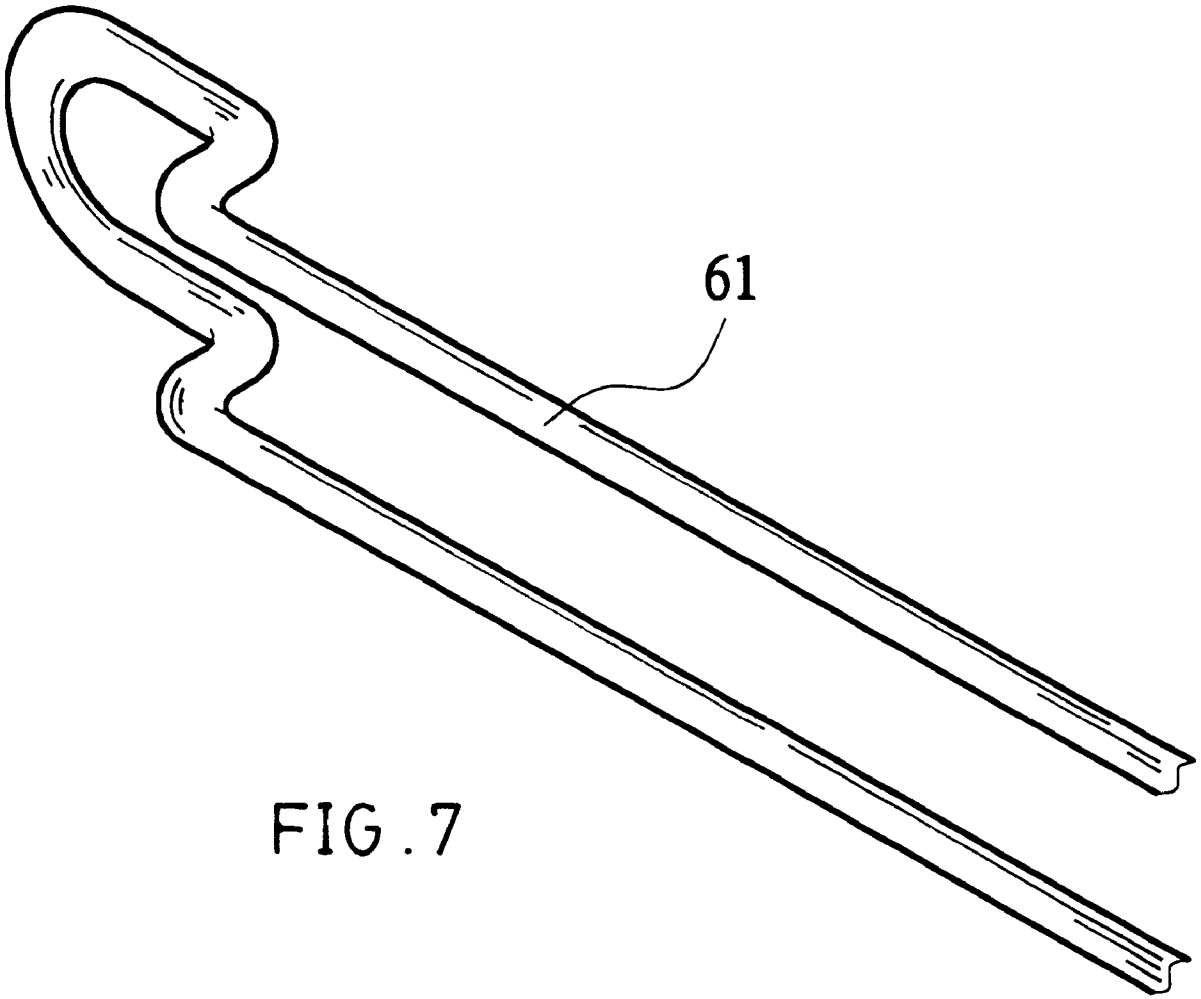
FIG. 7 is a schematic view of a reinforcement rib of this invention.

As shown in FIG. 6, 7, the frame body 11 includes a protective mantle 60, which is composed of a plurality of radiantly arranged reinforcement ribs 61 in U-form shape and locked to the frame body 11 with fixing bolts 21 in order to protect the leaf blades 50 and the mantle 60 against impairment in case the cooling fan falls on the floor.

Figure 8:
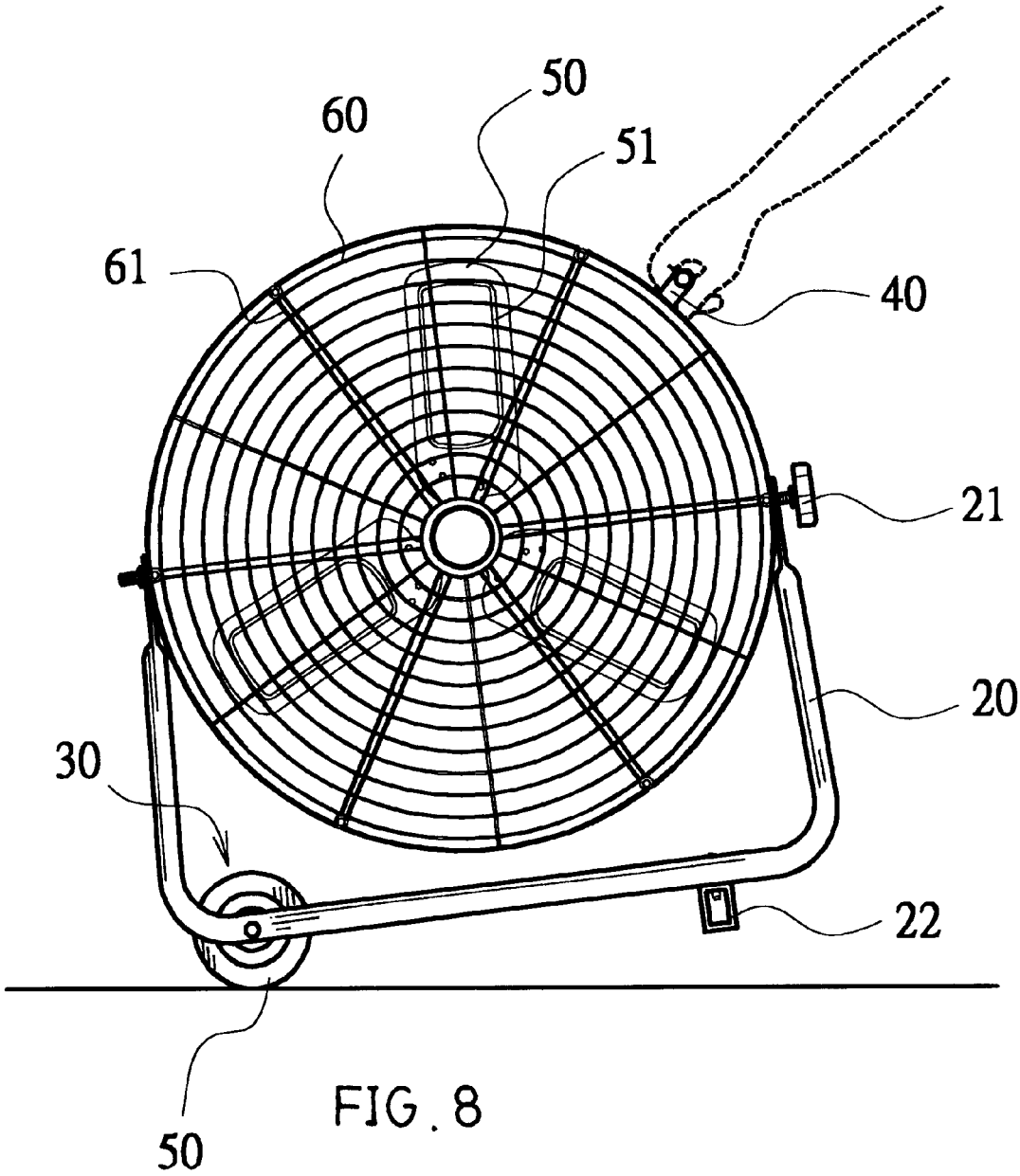
FIG. 8 is a schematic view showing this invention under operation.

The merits of this invention may be summarized as follows:

1. As the cooling fan is equipped with the wheels 31 and the handgrip 40, a user can move the fan to any desired place (as shown in FIG. 8).

2. The indented costa 51 and the smaller twist angle θ in the leaf blades 50 are helpful in strengthening the blown airflow.

3. The reinforcement ribs 61 increases the strength of the protective mantle 60 to prevent the mantle and the blades from being impaired in case the cooling fan falls on the floor.

What is claimed is:

1. A portable cooling fan comprising:

a plurality of leaf blades that rotate about a single axis of rotation, each of the leaf blades comprising an entire periphery, and upper and lower surfaces, the leaf blades each comprising an indented costa formed substantially along the entire periphery of each of the leaf blades such that the upper surface of each of the leaf blades includes a protruded hollow portion, and the rear surfaces of each of the leaf blades includes an indented hollow portion around the entire periphery of the protruded hollow portion of each of the leaf blades;

a frame body within which the leaf blades rotate;

a fixing rack comprising a pair of U-shaped reinforcement ribs, which are adjustably attached such that the U-shaped reinforcement ribs extend below the fixing rack;

a wheel set rotatively attached to the fixing rack between the pair of the U-shaped reinforcement ribs such that the wheel set contacts a surface below the fan; and a hand grip attached to the frame body at an upper position thereof.

2. The portable cooling fan as claimed in claim 1, wherein a support rod is positioned between the pair of the U-shaped reinforcement ribs and positioned apart from the wheel set, such that the support rod contacts a surface below the fan in conjunction with the wheel set.

3. The portable cooling fan as claimed in claim 1, wherein each of the leaf blades is angled toward the axis of rotation by a twist angle, in order to increase intensity of airflow.

4. The portable cooling fan as claimed in claim 1, wherein the frame body includes a protective mantle that is provided with a plurality of reinforcement ribs.

* * * * *